United States Patent [19]

Hultquist

[11] Patent Number: 4,569,173

[45] Date of Patent: Feb. 11, 1986

[54] METHOD FOR CONSTRUCTING BUILDINGS AND BUILDING STRUCTURES

[75] Inventor: David Hultquist, Canoga Park, Calif.

[73] Assignee: Balboa Construction Co., Inc., Chatsworth, Calif.

[21] Appl. No.: 657,736

[22] Filed: Oct. 4, 1984

[51] Int. Cl.[4] ..... E02D 27/00

[52] U.S. Cl. ..... 52/293; 52/294; 52/742

[58] Field of Search ..... 52/293, 294, 295, 741, 52/742, 274, 169.5

[56] References Cited

U.S. PATENT DOCUMENTS

| | | | |
|---|---|---|---|
| 3,685,241 | 8/1972 | Cooper | 52/293 X |
| 3,852,925 | 12/1974 | Gazzo | 52/169.5 |
| 4,290,246 | 9/1981 | Hilsey | 52/293 X |

FOREIGN PATENT DOCUMENTS

| | | | |
|---|---|---|---|
| 2614186 | 10/1977 | Fed. Rep. of Germany | 52/294 |

*Primary Examiner*—Carl D. Friedman

*Attorney, Agent, or Firm*—Lewis Anten; Robert B. Block

[57] ABSTRACT

The method for constructing a building begins by pouring slab floors from nine inches to twelve inches less than the inside width of the finished floors of a number of buildings in a project in one phase of the project work, and, thereafter trenching and pouring footings about the floors to leave a space between the slabs and the footings in a subsequent phase of the project work. The upper elevation of the footings is set to provide the desired pitch of each building roof. Precast walls are made of standard height and length and set on the footings, the lower sections of the walls, and footings both having hooked rebars adapted to be interconnected together with the mesh reinforcing of each slab floor within the nine to twelve inch "poor strip" space provided. A pour strip or closure strip of concrete is poured over the rebars and continues the slab floor to the wall surface and downwardly to the footing. Beam hangers are welded to reinforced plates set in the walls and bridging adjoining adjacent wall sections. The beam hangers assume the same pitch as defined by the difference in wall elevations based on the fall of the footings so that the roof pitch and fall are set accordingly. The building structure incorporates the novel features mentioned in combination with the closure strip uniting the slab floor, walls, and footings, and the adjustment for roof slope with standard, precast walls. The structure of the reinforced plates and beam hangers joining the upper corners of the walls is novel. The walls are usually ten feet high by twenty feet in length and are provided with standardized openings therein for cargo and passage doors.

11 Claims, 8 Drawing Figures

74
64
62
66
72
70
68
42
30
31
32
33
30
31
28
28
15
24
60
18
10
26
22

METHOD FOR CONSTRUCTING BUILDINGS AND BUILDING STRUCTURES

BACKGROUND OF THE INVENTION

This invention relates to a method for the construction of buildings, particularly of the one-story type such as are used for storage of household goods, and to the building structure so made.

Heretofore, it has taken as long as nine months to complete the conventional structure of such buildings from the groundbreaking to completion for use. This represents a considerable loss in revenue since financing is required for this period without generating any income. Existing construction methods commonly use a slab floor set on footings on which present walls are raised, girded, and roofed. Starting with a level floor and footings requires the walls to be made with varying height in order to provide for roof slope. In addition, the usual practice of pouring footings first and subsequently slab the floor over involves time consuming operations of digging the footings, placing reinforcing steel in the footings, and pouring the peripheral foundation up to ground level. Then, for each unit, the required fill of sand and gravel for each rod is individually supplied, leveled, and compacted, and the slab poured for each unit.

There is, therefore, a need for a new and improved method for constructing buildings and structure.

SUMMARY OF THE INVENTION AND OBJECTS

In general, it is an object of the present invention to provide a method for constructing storage buildings and resulting structure which will overcome the above limitations and disadvantages and in particular, which will substantially cut the construction time from groundbreaking to completion.

In general, the present invention calls for a revised system for constructing storage buildings in which the slab floors for a number of units in the project are developed, poured and completed first, before any trenching for footings. Thus, the building site for the entire project is first leveled to engineering specification for draingage and the required sand, gravel, and leveling operations are completed for all pads in at least a section, and then these slabs are poured, before any footings are dug or poured. Each slab floor is poured about nine to twelve inches away from the final design boundary of each floor. After the slab floors are set, the footings are trenched and poured with the nine to twelve inch separation from the slabs and, the footings are trenched and poured with offset heights equal to the total fall desired in the roof of the building. For example, if the fall of the roof is desired to be six inches, the footings would be offset in height by the same amount. Walls are precast all to one height and usually the same length, i.e., ten feet high by twenty feet long. The walls are placed on the footings. The footings and the walls are cast with hook rebars which extend through the lower sections of the walls and protrude upwardly from the footings into the space between slab and the wall. The hook rebars interconnect the footings and walls with the reinforcing mesh extending laterally out from the slab. A concrete closure in the form of a pour strip is poured into this space to tie the wall, the footings, and the slab together and form a flush continuation of the slab extending therefrom right up to the walls all about.

Beam hangers are welded to reinforced plates set in the walls so that a hanger spans the plates of adjacent walls sections, the beam hangers providing a pitch established by the difference in the footing height.

DETAILED DESCRIPTION OF THE PREFERRED EMBODIMENT

Referring to FIGS. 1 through 6, the steps of the method of the invention are set forth in progressive sketches which show the progress of the construction of the building in accordance with the present invention.

Figure 1:
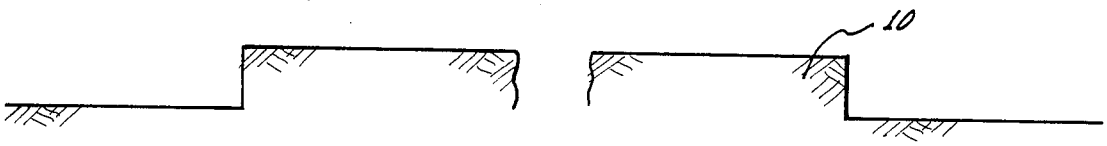
FIGS. 1 through 6 illustrate the steps for constructing a building in accordance with the present invention.
Figure 2:
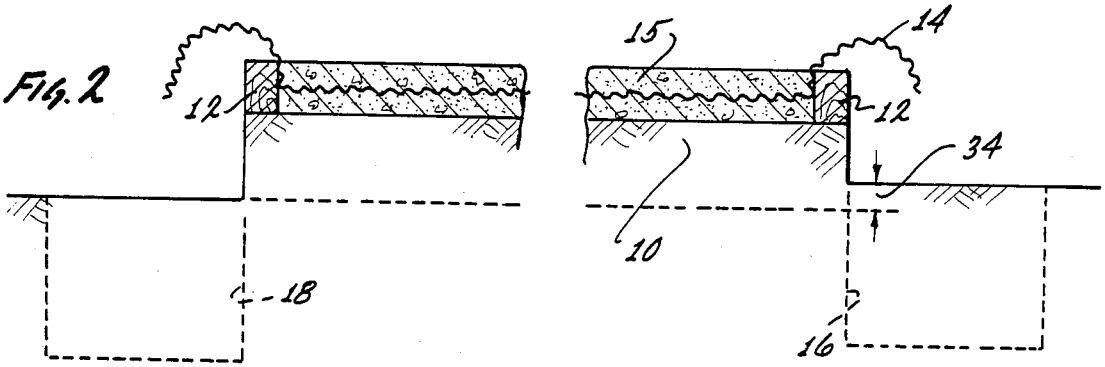

In the step of FIG. 1, the ground has been grubbed and cleared and sufficient rock and aggregate 10 necessary to meet soil standards has been added to form a pad which is prepared to specified level of all the pads in the project, or at least a significant number of them. In FIG. 2, forms 12 are set all around the pad to give lateral support and to define a slab boundary which is intensionally set nine to twelve inches in from the eventual inside design width of the building. A reinforcing mesh 14 is supported by suitable means throughout the extent of the pad and within its thickness dimension, usually at about mid-height. The slab 15 is then poured to a depth of about four inches minimum thickness.

Thereafter, footing trenches 16, 18 (FIG. 2 are dug in a manner to provide that the walls can be set nine to twelve inches away from the pad perimeter, i.e., the pad perimeter is back from the eventual full width of the floor. The footings are trenched to a depth having a difference in level corresponding to the desired fall of the roof, namely, the desired pitch of the roof over the building width. The forms of the slab floor are removed at some convenient point.

Figure 3:
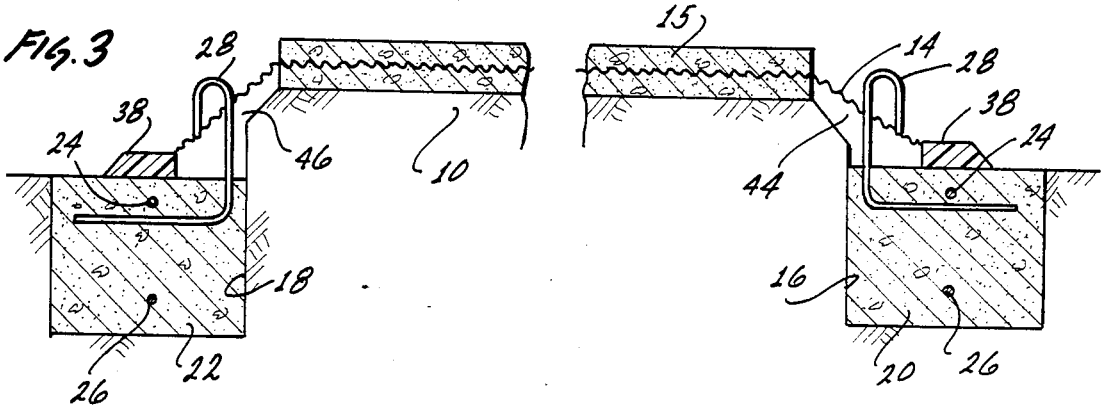
Figure 4:
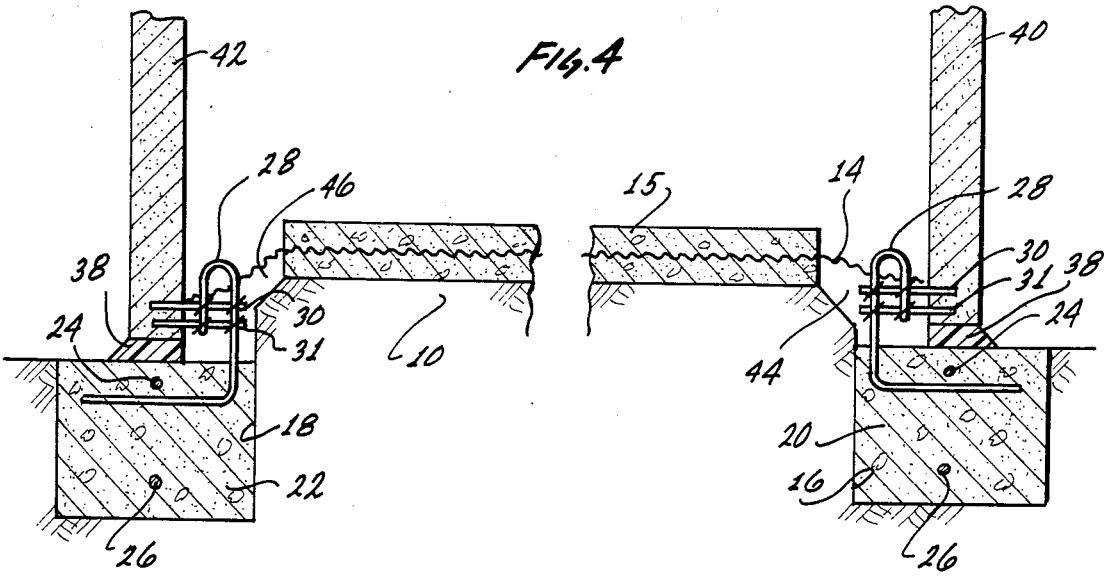
Figure 5:
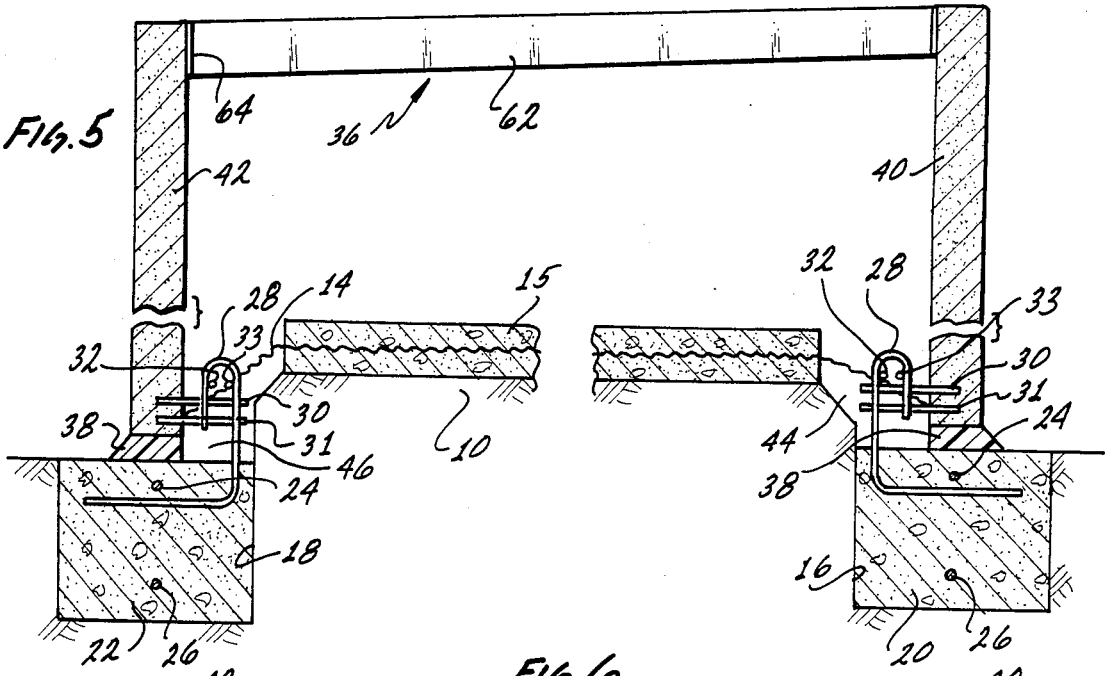

As shown in FIG. 3, the footings 20, 22 are poured about rebars of reinforcing steel which include elongate bars 24, 26 extending the entire length of the footings and upstanding hook bars 28 located at designated locations adjacent to and inside of where the walls to be set on the footings will terminate. The hook bars are adapted to secure the walls by looping around hook rebars 30, 31 and short four foot sections of straight rebars 32 (FIG. 5) provided in the space defined by the edge of the slab and the wall to be set on the footing and the footing itself.

Figure 6:
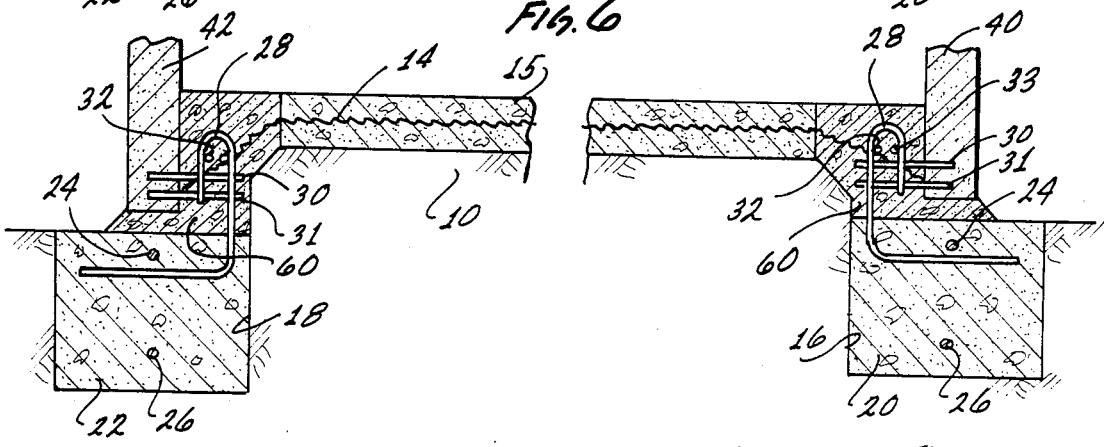
Figure 7:
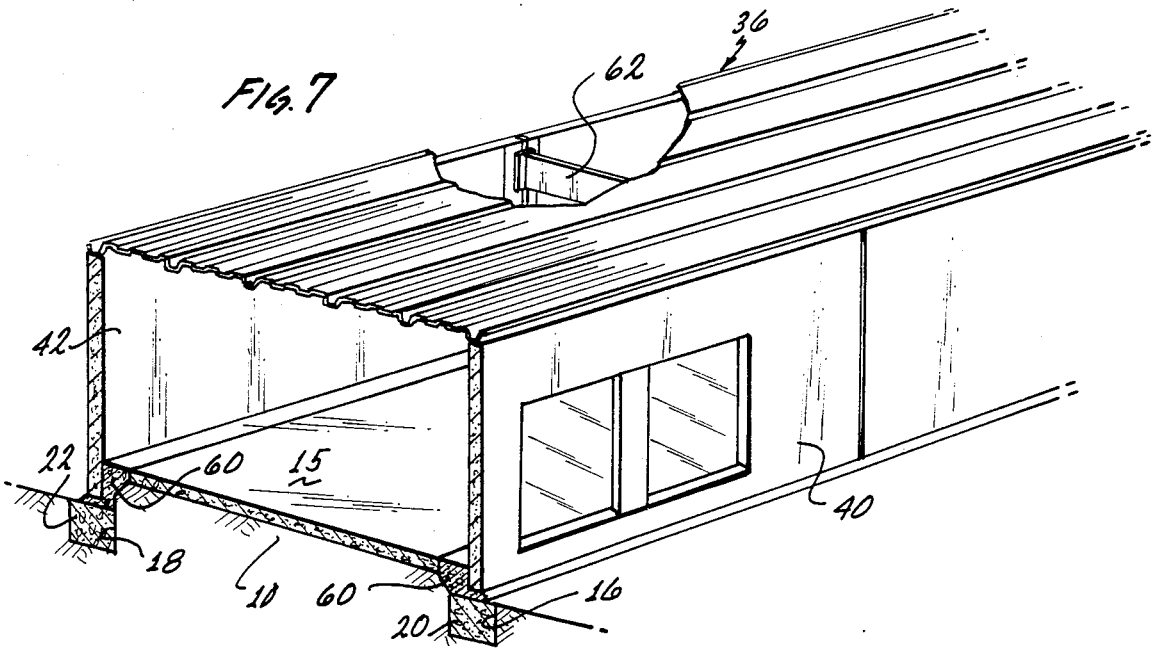
FIG. 7 is a perspective view of a building structure constructed in accordance with the invention and with the procedure of FIGS. 1 through 6.

The walls are precast in the usual manner; however, they are of uniform dimensions in height and length, usually about ten foot high by twenty foot long. As seen in FIG. 6, the difference 34 in elevation of the footings controls the eventual difference in height of the walls and, thus, the pitch and fall of the roof as at 36.

A pair of spaced plastic leveling pads or shims 38 are laid on the footings (FIG. 3) and walls 40, 42 are raised (resting on shims 38) (FIG. 4) with the projecting hook rebars 30 protruding from their lower inside sections which are tied onto rebars 28 of the footings. The mesh 14 from the slab is allowed to droop into the same cross-sectional areas 44, 46 generally occupied by the wall and slab rebars and the two additional straight rebars 32, 33 are passed through each set of hook rebars assemblies and all of the rebars are tied together appropriately with the mesh 14.

Figure 8:
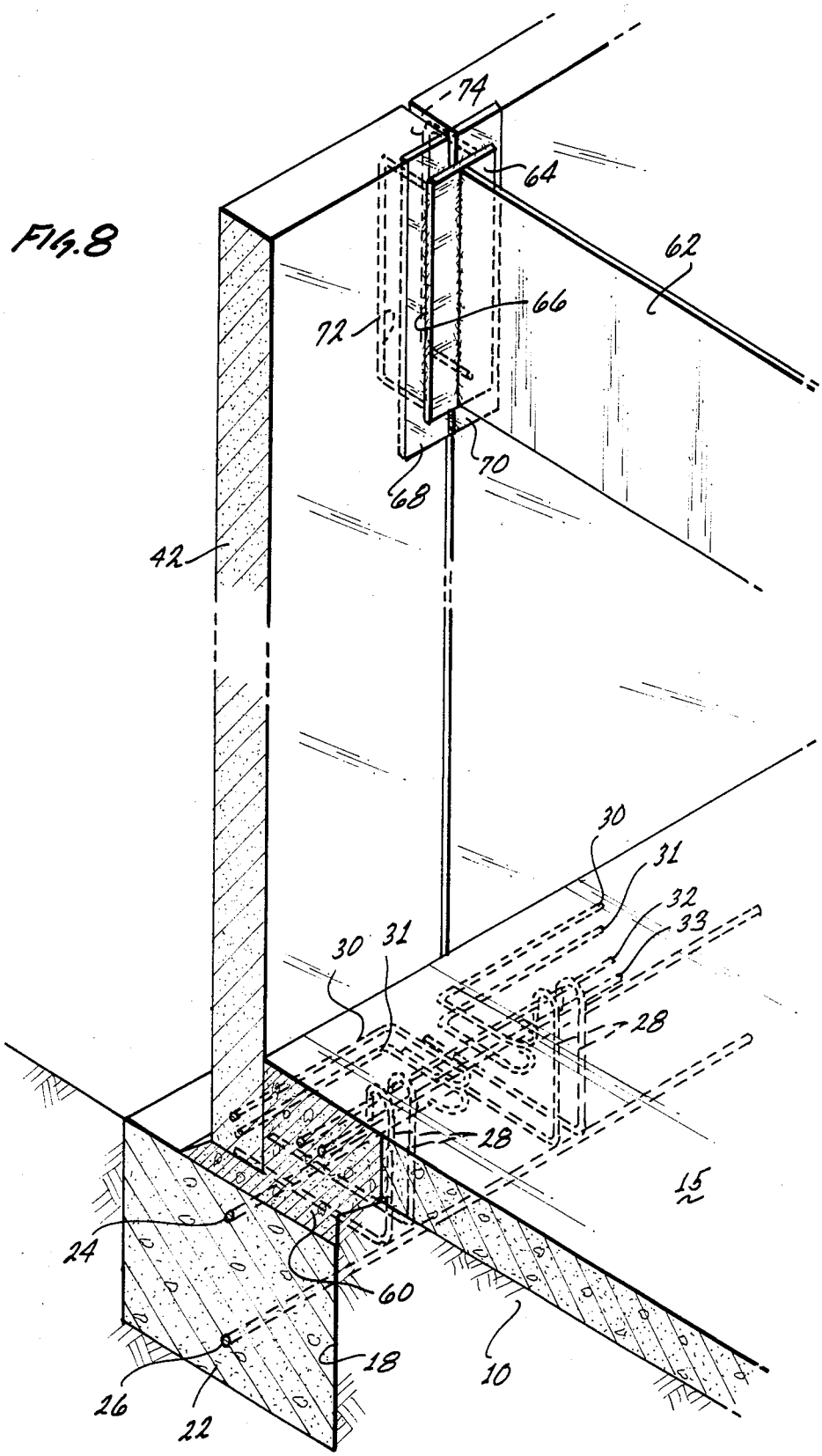
FIG. 8 is an enlarged view, partially in section, showing details of the structure of FIG. 7.

FIG. 8 shows a isometric view of the reinforcing arrangement in greater detail. Thus, as shown, each of the wall hook rebars 30, 31 form hooks within a segment buried in and along the lower part of the wall and an exposed segment which curves out in a horizontal plane to protrude from the inside of the wall into a loop turning back toward the wall and within the unfilled section between it and the slab. The footing hook rebars 28, 29 have a segment buried in the footing continued into an exposed, vertical segment which protrudes upwardly and loops back toward the footing. These footing rebars are provided on each side of each juncture of two walls and also the ends. Also, a pair 32, 33 of two shorter lengths of straight rebars are passed through the vertical hook rebars and all tied in place in the trough formed between slab, wall, and footing. The reinforcing mesh (not shown, for clarity) is allowed to drop into the trough. In this way, the reinforcing are means provided at the juncture of each wall panel serves to tie the wall panel and the footing together with hook rebars and also the reinforcing mesh from the slab extending into the same region so that the total floor, wall and footing is structurely intergrated into the closure strip all about the building.

After the reinforcing is tied, a concrete closure strip 60 is poured into the trough between and around the pads 15 to fill in up to the level of the slab and out to the wall and underneath the wall between the shims 38.

The wall structures are assumed to have been raised by conventional supports and are prefabricated of more than one type to provide various size door openings. But the wall sections are standardized and identical with respect to overall length and height.

After the walls are raised, it is seen that the pitch and fall of the roof is established by the fall of the footings themselves. The walls and roof are supported by beam hangers in the form of a girders 62 with end plates 64 welded above their periphery at 66 to a pair of plates 68, 70 integrally formed into the upper corners of the walls and facing inwardly. These weld plates 68, 70 are reinforced by intergral rebars 72, 74 buried into the cast wall section. Each end plate 64 of the beam hangers span across a adjacent pair of weld plates of the abutted walls to which each end plate is welded about entire perimeter to form a strong structural bond therebetween. The remaining details of the roof structure and support of the same on the beam hangers may be conventional and will not be given here in detail.

What is claimed is:

1. Method for constructing a building comprising, forming a slab floor to extend slightly less than the interior width of the building, thereafter forming footings thereabout at a predetermined level such that the height of the footings differs from side to side of the building by the amount desired pitch of roof, said footings being spaced from the slab and located at the exterior wall limit of the building, forming prefabricated walls, said walls being of equal height, raising the walls on the footings with the result of an unequal height due to the difference in elevation of the footings, spanning the upper ends of the walls from side to side of the building with girders to support the walls and roof, pouring a concrete closure strip into the space between the slab floor and the footings.

2. The method as in claim 1 further including the step of reinforcing the lower wall, slab, and footing with steel reinforcing bars extending into and bonded together by the closure strip.

3. The method as in claim 2 in which said reinforcing step includes providing a hook bar reinforcing extending upwardly from the inside portion of the footing, providing a hook bar reinforcing means extending laterally from the inside of the wall at its lower most extreme, said footing and wall reinforcing means being constructed and arranged to loop each other so that they mutually couple upon the pouring of said closure strip.

4. Method of constructing a building comprising, forming a slab floor to extend slightly less than the interior width of the building, thereafter forming footings thereabout at a predetermined levels, said footings being spaced from the slab and located at the exterior wall limit of the building, forming prefabricated walls, raising the walls on the footings, spanning the upper ends of the walls from side to side of the building with girders to support the walls and roof, pouring a concrete closure strip into the space between the slab floor and the footings.

5. The method as in claim 4 further including the step of reinforcing the lower wall, slab, floor and footing with steel reinforcing bars extending into and bonded together by the closure strip.

6. The method as in claim 2 in which said reinforcing step includes providing a hook bar reinforcing extending upwardly from the inside portion of the footing, providing a hook bar reinforcing means extending laterally from the inside of the wall at its lower most extreme, said footing and wall reinforcing means being constructed and arranged to loop each other so that they mutually couple upon the pouring of said closure strip.

7. A concrete building comprising, a concrete slab floor laid to extend slightly less than the interior width of the building, concrete footings formed about the floor at a predetermined levels such that the height of the footings differs from side to side of the building by the amount desired pitch of roof, said footings being spaced from the slab and located at the exterior wall limit of the building, prefabricated walls, said walls being raised on the footings, a set of girders spanning the upper end of the walls from side to side of the building to support the walls and roof, a concrete closure strip poured into the space between the slab floor and the footings.

8. The concrete building as in claim 7 further including reinforcing laid within the slab floor footings and walls, said reinforcing extending into and bonded together by the closure strip.

9. The building as in claim 8 in which said reinforcing includes hook bar reinforcing means extending upwardly from the inside portion of the footing, hook bar reinforcing means extending laterally from the inside of the wall at its lower most extreme, said footing and wall reinforcing means being constructed and arranged to loop each other so that they mutually couple upon the pouring of said closure strip.

10. A concrete building comprising a slab floor formed to extend slightly less than the interior width of the building, footings formed thereabout at a predetermined levels such that the height of the footings differs from side to side of the building by the amount desired pitch of roof, said footings being spaced from the slab and located at the exterior wall limit of the building, prefabricated walls, said walls being of equal height and raised on the footings with the result of an unequal height due to the difference in elevation of the footings, girder means spanning the upper ends of the walls from side to side of the building to support the walls and roof, a concrete closure strip poured into the space between the slab floor and the footings.

11. The building as in claim 10 in which said reinforcing includes providing first hook bar means extending upwardly from the inside portion of the footing, providing second hook bar means extending laterally from the inside of the wall at its lower most extreme, said footing and wall reinforcing means being constructed and arranged to loop each other so that they mutually couple upon the pouring of said closure strip.

* * * * *